US008319446B2

(12) United States Patent
Hierl et al.

(10) Patent No.: US 8,319,446 B2
(45) Date of Patent: Nov. 27, 2012

(54) CIRCUIT FOR CONTROLLING A FLUORESCENT LAMP, METHOD FOR OPERATING THE CIRCUIT, AND SYSTEM COMPRISING THE CIRCUIT

(75) Inventors: Wolfgang Hierl, Kirchweidach (DE); Thomas Pollischansky, Stadtbergen (DE); Bernhard Schemmel, Wessling (DE); Harald Schmitt, Munich (DE); Raphael Stocker, Munich (DE); Arwed Storm, Dachau (DE)

(73) Assignee: Osram AG, Munich (DE)

( * ) Notice: Subject to any disclaimer, the term of this patent is extended or adjusted under 35 U.S.C. 154(b) by 238 days.

(21) Appl. No.: 12/532,157

(22) PCT Filed: Apr. 19, 2007

(86) PCT No.: PCT/EP2007/053840

§ 371 (c)(1),
(2), (4) Date: Sep. 20, 2009

(87) PCT Pub. No.: WO2008/128565

PCT Pub. Date: Oct. 30, 2008

(65) Prior Publication Data

US 2010/0102739 A1 Apr. 29, 2010

(51) Int. Cl.
*H05B 41/36* (2006.01)

(52) U.S. Cl. ..... 315/224; 315/209 R; 315/246; 315/291; 315/307; 315/DIG. 5

(58) Field of Classification Search ..... 315/209 R, 315/224–226, 246, 247, 291, 307, 308, 311, 315/DIG. 2, DIG. 5, DIG. 7
See application file for complete search history.

(56) References Cited

U.S. PATENT DOCUMENTS

| | | | | |
|---|---|---|---|---|
| 6,020,691 | A * | 2/2000 | Sun et al. | 315/307 |
| 6,400,095 | B1 * | 6/2002 | Primisser et al. | 315/224 |
| 6,426,597 | B2 * | 7/2002 | Rast et al. | 315/219 |
| 6,650,514 | B2 | 11/2003 | Schmitt | |
| 7,378,807 | B2 * | 5/2008 | Feldtkeller et al. | 315/308 |
| 2005/0012472 | A1 * | 1/2005 | Soehnel | 315/291 |
| 2005/0062432 | A1 * | 3/2005 | Van Casteren | 315/127 |
| 2005/0269969 | A1 * | 12/2005 | Van Casteren | 315/291 |

FOREIGN PATENT DOCUMENTS

| | | | |
|---|---|---|---|
| DE | 10108138 | A1 | 8/2002 |
| EP | 1233657 | B1 | 7/2007 |
| WO | 03055281 | A1 | 7/2003 |

OTHER PUBLICATIONS

International Search Report—PCT/EP2007/053840—dated Dec. 19, 2007.

* cited by examiner

*Primary Examiner* — Douglas W Owens
*Assistant Examiner* — Thai Pham

(57) ABSTRACT

In various embodiments, a circuit for driving a fluorescent lamp is provided. The circuit may include a half bridge including a first switch and a second switch; a drive unit for driving the first switch and the second switch, it being possible for a predetermined state to be established using the drive unit, and it being possible for the driving of the first and the second switch to be modulated as a result of the predetermined state using the drive unit.

15 Claims, 3 Drawing Sheets

CIRCUIT FOR CONTROLLING A FLUORESCENT LAMP, METHOD FOR OPERATING THE CIRCUIT, AND SYSTEM COMPRISING THE CIRCUIT

RELATED APPLICATIONS

The present application is a national stage entry according to 35 U.S.C. §371 of PCT application No.: PCT/EP2007/053840 filed on Apr. 19, 2007.

TECHNICAL FIELD

Various embodiments relate to a circuit for driving a fluorescent lamp, to a method for operating the circuit and to a system comprising the circuit.

BACKGROUND

For a large number of electronic ballasts for fluorescent lamps, current standards require identification and disconnection of the lamps at the end of their life ("end-of-life" disconnection).

A protective circuit for disconnecting the fluorescent lamp at the correct time is known from DE 101 08 138 A1. As long as the fluorescent lamp is still not defective, a criterion is evaluated which results in a disconnection of a half-bridge arrangement at the correct time prior to overheating in the filament region (risk of fusing of the lampholder). In the case of the fluorescent lamp, the filaments are covered by emitters in order to reduce the work function of the electrons. At the end of life of the fluorescent lamp, an emitter which is increasingly absent on an electrode (lamp filament) results in the work function increasing and therefore the voltage drop across an output capacitor being altered.

During normal operation, i.e. before the end of life of the fluorescent lamp is reached, the potential at two reference points in the circuit is compared. Thus, the two reference points on average are at a potential which corresponds to half the voltage which is made available by the DC voltage source.

Towards the end of life, the potential at one of the reference points changes, and this results in a voltage difference between the two reference points. An evaluation circuit detects these changed voltage conditions, wherein a threshold value can be set above which deactivation of the half-bridge arrangement takes place.

In order to prevent an end of life being identified and the fluorescent lamp being disconnected erroneously, the above-mentioned asymmetrical state is awaited for a predetermined period of time (for example approximately 20 seconds) and only then is the disconnection of the fluorescent lamp introduced.

Thus, a correctly operating electronic ballast identifies an asymmetry, waits for the predetermined period of time and then switches off the fluorescent lamp.

Since an erroneously produced electronic ballast can result in premature disconnection of the device (complaint) or else faulty operation (no disconnection, safety risk), it is necessary and conventional to also test the electronic ballast in an assembled state critically and uncritically in each case in two directions of asymmetry.

If the 20 seconds mentioned above by way of example for an asymmetry test are used, the tests in both directions (any electrode or filament of the fluorescent lamp can bring about a shift in potential, but in a different direction) on their own result in a test duration of 40 seconds.

Such long test times correspondingly increase the production costs.

SUMMARY

Various embodiments may avoid the abovementioned disadvantages and may reduce the test times and therefore the production costs.

Various embodiments provide a circuit for driving a fluorescent lamp with a half bridge which includes a first switch and a second switch. A drive unit is provided for driving the first switch and the second switch, with it being possible to establish a predetermined state using the drive unit, and it being possible to modulate the driving of the first switch and of the second switch as a result of the predetermined state and/or with modulated driving of the first switch and of the second switch taking place.

In particular, the modulated driving may be frequency-modulated driving.

In this case it is advantageous that the predetermined state triggers the modulation and therefore the current path of the circuit is provided with additional information on the predetermined state. Associated demodulation can be used to detect this additional information. It is therefore possible to establish, for example during a function test of the electronic ballast, which is in particular performed without the fluorescent lamp used, whether a (simulated) fault event is identified by the ballast. If this is the case, the mentioned modulation is initiated, a tester can identify this and end the test on the assumption that the test has been passed. With the identified fault event, it is not necessary to wait the entire period of time up to disconnection.

This results in a considerable shortening of the test procedure.

A development consists in the fact that a resonant circuit can be driven via the half bridge. The resonant circuit is preferably designed for operation of the fluorescent lamp.

A development consists in the fact that the predetermined state is an increase in the work function in one of the electrode filaments of the fluorescent lamp.

Another development consists in the fact that the predetermined state corresponds to a fault state of the fluorescent lamp.

In particular, a development consists in the fact that the predetermined state corresponds to asymmetrical wear of an emitter on at least one filament of the fluorescent lamp.

Another development consists in the fact that the predetermined state corresponds to an imminent end of life of the fluorescent lamp.

Likewise, a development consists in the fact that the driving of the first switch and of the second switch can be modulated between a first frequency and a second frequency.

A development also consists in the fact that the driving of the first switch and of the second switch can be modulated between a first frequency and a second frequency with a third frequency.

A development consists in the fact that the driving of the first switch and of the second switch can be swept using the third frequency.

In addition, a development consists in the fact that an output capacitor or an in particular high-resistance resistor is connected to the circuit and the third frequency can be detected using the output capacitor or the in particular high-resistance resistor.

Another development consists in the fact that an integrated circuit is provided which includes the drive circuit.

In particular, the integrated circuit can be in the form of an ASIC.

A development consists in the fact that the predetermined state can be interrogated using the modulated driving of the first switch and of the second switch.

A refinement consists in the fact that the circuit can be used for establishing a fault event of the fluorescent lamp.

Also, the circuit can be used for testing the predetermined state of the fluorescent lamp.

In a further refinement, the circuit is an electronic ballast for the fluorescent lamp.

It is noted here that the switches are preferably electronic switches, in particular transistors, FETs, MOSFETs.

Also, the drive unit can include analog and/or digital components.

Furthermore, in various embodiments, a method in particular for operating a circuit for driving a fluorescent lamp is provided wherein the circuit can correspond to the embodiments in the approach proposed here. The method includes the following: (i) detection of a predetermined state, and (ii) modulation of a drive signal as a result of the detected state.

A development consists in the fact that the modulation of the drive signal is altered between a first frequency and a second frequency with a third frequency.

Another development consists in the fact that a first switch and a second switch of a half bridge are operated using the drive signal. In particular, the switches of the half bridge are operated in such a way that a resonant circuit which is designed to comprise the fluorescent lamp can be driven.

Furthermore, the object is achieved using a light-emitting means and/or a (light-emitting) system comprising a circuit as explained here.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
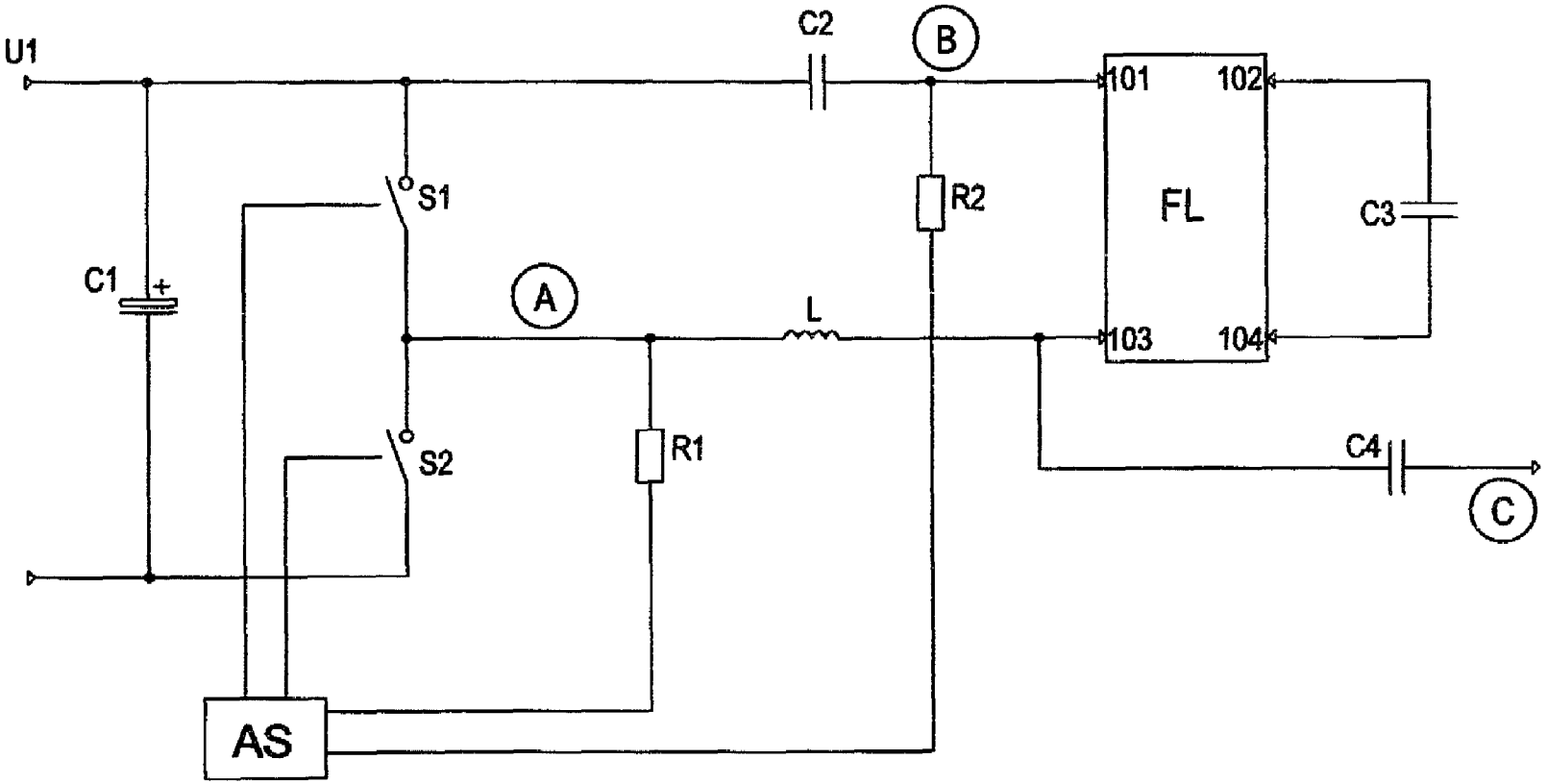
FIG. 1 shows a circuit diagram of a circuit for driving afluorescent lamp.
Figure 3:
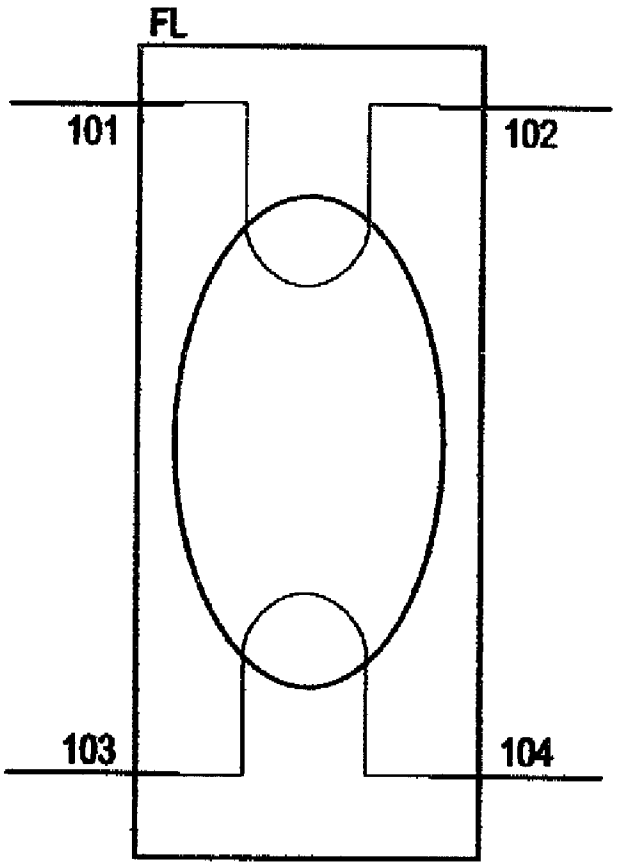
FIG. 3 shows a switching symbol for a fluorescent lamp.

FIG. 1 shows a circuit arrangement for driving a fluorescent lamp FL. The fluorescent lamp FL can be connected via four terminals 101, 102, 103, 104. These terminals are assigned in accordance with the switching symbol in FIG. 3.

FIG. 1 shows a half bridge including two preferably electrical switches S1 and S2, for example transistors or MOSFETs, which are driven via a drive unit AS. A center tap between the switches S1 and S2 is referred to as a node A. The half bridge is connected in parallel with a capacitor C1 and in parallel with a supply voltage U1. The node A is also connected to the terminal 103 of the fluorescent lamp FL via a coil L. The input voltage U1 is connected, via a capacitor C2, to a node B, which is connected to the terminal 101 of the fluorescent lamp FL. A capacitor C3 is connected in parallel with the terminals 102 and 104 of the fluorescent lamp FL, and furthermore a capacitor C4 is coupled to the terminal 103, wherein that end of the capacitor C4 which is remote from the terminal 103 is referred to as the terminal C. Instead of the capacitor C4, an in particular high-resistance resistor can be provided.

A first input signal of the drive unit AS is connected to the node A via a resistor R1, and a second input signal of the drive unit AS is connected to the node B via a resistor R2.

The half bridge in FIG. 1 feeds the fluorescent lamp FL via the inverter and the resonant circuit. The fluorescent lamp FL has a first filament between the terminals 103 and 104 and a second filament between the terminals 101 and 102. The center point of the half bridge A is connected to the lamp FL via the coil L ("lamp inductor").

The mean potentials of the nodes A and B are compared with one another in the drive unit AS. In the event of a certain voltage difference between points A and B being exceeded, the drive unit AS deactivates the half bridge. The fluorescent lamp FL is disconnected.

During normal operation, the potentials of the nodes A and B are on average half the voltage U1. At the end of life of the fluorescent lamp FL, the potential at the node B is shifted as a result of a lack of emitter on one of the two filament electrodes of the fluorescent lamp FL. The work function of the filament electrode affected is therefore increased. The disconnection of the half bridge prevents overheating of the filament electrode.

Alternatively, this shift in potential can also be identified and detected using the voltage across the fluorescent lamp.

However, before disconnection of the fluorescent lamp takes place, a predetermined period of time is waited to ascertain whether it is merely a temporary shift in potential and the cause of this is not the end of life of the fluorescent lamp. If, for example, a wait time of 20 seconds is used, after the identification of the shift in potential beyond a certain limit value between the nodes A and B, there would be a wait of 20 seconds still before the fluorescent lamp is disconnected (if the shift in potential is not corrected again within this time).

In the present circuit, a shift in potential beyond the predetermined limit value is established via the drive unit AS, and in addition the driving of the two switches is modulated between a first frequency and a second frequency with a third frequency.

For example, the two switches S1 and S2 are driven during normal operation at a frequency of 43 kHz. If the drive unit AS identifies a shift in potential, the above-described wait time begins, the switches S1 and S2 continue to be driven, but in a frequency range of between 40 kHz and 45 kHz at a frequency of 1600 Hz. Using the frequency of 1600 Hz (third frequency), the drive frequencies are "swept" between 40 kHz and 45 kHz.

This has the advantage that, via the capacitor C4 and the terminal C, this modulation is identified (output) virtually immediately, i.e. the modulation with the third frequency is identified and it is therefore possible to detect, via the electric circuit of the circuit, whether the drive unit has detected a fault event of the fluorescent lamp.

It is noted here that an electronic ballast can include the circuit shown in FIG. 1. Such an electronic ballast has the terminals 101 to 104 for the connection of a fluorescent lamp.

Figure 2:
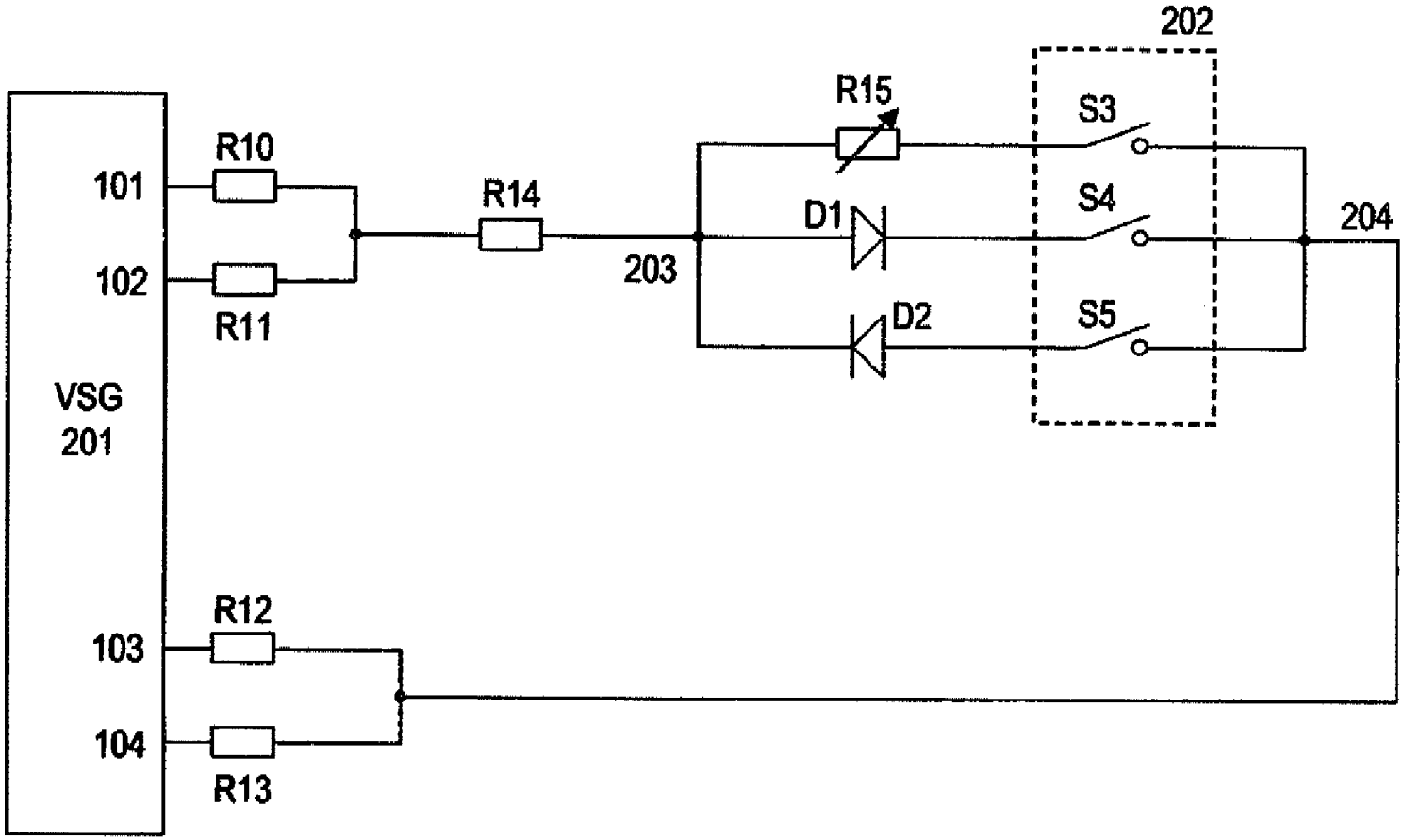
FIG. 2 shows a circuit diagram of a possible test circuit for an electronic ballast.

For testing of the electronic ballast during or after production thereof, there is no fluorescent lamp connected, but instead in particular a test circuit as shown in FIG. 2 is implemented.

In FIG. 2, the terminals 101 to 104 correspond to those of the ballast VSG 201 as shown in FIG. 1. The terminals 101 and 102 are connected to one another via resistors R10 and R11 and further to a node 203 via a resistor R14. The terminals 103 and 104 are connected to a node 204 via resistors R12 and R13. The resistors R10 to R13 in this case correspond to the electrode filaments, and the resistor R14 simulates the (intact) fluorescent lamp.

A parallel circuit including a variable resistor R15, a diode D1 and a diode D2 with opposite polarity to the diode D1 is provided between the nodes 203 and 204, wherein each of the parallel paths is designed such that it can be switched via a switching unit 202 including switches S3, S4 and S5. This part simulates the asymmetrical behavior of the fluorescent lamp.

By means of the circuitry of the ballast 201 shown, in particular the abovementioned fault event "end of life" of the fluorescent lamp is simulated. Thus, asymmetrical tests are carried out or lamps which have emitter disappearance on one side are emulated via the individually switched diodes (together with a corresponding resistor R15 connected in parallel).

Each asymmetrical test can be identified immediately, using the above-described circuit, for example via the node C in FIG. 1; it is not necessary to in each case wait 20 seconds until the drive unit stops the half bridge. As a result, when the electronic ballasts are tested, a significant time saving can be achieved.

It can therefore be tested successfully and quickly whether a fault state (in this specific case asymmetrical wear of the fluorescent lamp) which is emulated on the ballast and which, for lamp-physical reasons, has a long time constant before the introduction of the device shutdown, is also correctly identified by a completely assembled ballast.

When the fault threshold is reached (transition from uncritical to critical asymmetry), modulation is impressed upon the lamp operating current, which modulation is evaluated by an external detector circuit. The frequency of this modulation is preferably markedly above the system frequency (50 Hz) but markedly below the operating frequency of the device (typically 45 kHz). The modulation can be provided in the range of from 1-3 kHz; in this range, a simple detector circuit (for example capacitive or high-resistance output from the lamp feed line) can still produce an easily usable signal.

A further advantage of this procedure is the fact that all of the asymmetry states (positive diode direction critical, positive diode direction uncritical, negative diode direction critical, negative diode direction uncritical, all measurements a second time in the case of parallel circuit of lamps) can be tested without a disconnection taking place and without the device needing to be restarted after each measurement.

This approach can be realized in a ballast with a microcontroller, with a lamp control ASIC and/or discretely.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit for driving a fluorescent lamp, the circuit comprising:

a half bridge comprising a first switch and a second switch, a drive unit for driving the first switch and the second switch at a switching frequency, said drive unit being configured to indicate a fault state of the fluorescent lamp by modulating said switching frequency while providing a driving current for said fluorescent lamp.

2. The circuit as claimed in claim 1, in which the driving of the first switch and of the second switch can be modulated between a first frequency and a second frequency.

3. The circuit as claimed in claim 2, in which the driving of the first switch and of the second switch can be modulated between the first frequency and the second frequency at a third frequency.

4. The circuit as claimed in claim 3, in which the driving of the first switch and of the second switch can be swept between the first and second frequency at the third frequency.

5. The circuit as claimed in claim 1, wherein an integrated circuit is provided which comprises the drive circuit.

6. The circuit as claimed in claim 5, wherein the integrated circuit is an ASIC.

7. The circuit as claimed in claim 1, wherein the circuit is an electronic ballast for the fluorescent lamp.

8. The circuit as claimed in claim 1, wherein the modulation of said switching frequency takes place during a waiting period prior to shut down of said driving current.

9. The circuit as claimed in claim 1, wherein said fault state triggers a predetermined waiting period.

10. An arrangement comprising a circuit and a test circuit, a half bridge comprising a first switch and a second switch, a drive unit for driving the first switch and the second switch at a switching frequency, said drive unit being configured to indicate a fault state of the fluorescent lamp by modulating said switching frequency while providing a driving current for said fluorescent lamp, wherein the driving of the first switch and of the second switch can be modulated between a first frequency and a second frequency, the driving of the first switch and of the second switch can be modulated between the first frequency and the second frequency at a third frequency, and the test-circuit comprising:

at least one of an output capacitor or a resistor connected to the circuit, and the third frequency can be detected using at least one of the output capacitor or the resistor.

11. The arrangement as claimed in claim 10, wherein the fault state of the fluorescent lamp can be interrogated using the modulated driving of the first and of the second switch.

12. A method for testing a circuit for operating a fluorescent lamp, the method comprising:

detecting a fault state of the fluorescent lamp;

modulating a drive signal; and detecting a modulation of the drive signal by a test circuit.

13. The method as claimed in claim 12, wherein the modulation of the drive signal is altered between a first frequency and a second frequency with a third frequency.

14. The method as claimed in claim 12, wherein a first switch and a second switch of a half bridge are operated using the drive signal.

15. A light-emitting system comprising a circuit for driving a fluorescent lamp, the circuit comprising:

a half bridge comprising a first switch and a second switch;

a drive unit for driving the first switch and the second switch at a switching frequency, the drive-unit being configured to indicate a fault state of the fluorescent lamp by modulating said switching frequency while driving said fluorescent lamp.

* * * * *